United States Patent [19]

Ishizuka

[11] Patent Number: 4,480,965

[45] Date of Patent: Nov. 6, 1984

[54] CAPACITY MODULATION DEVICE FOR COMPRESSOR

[75] Inventor: Yutaka Ishizuka, Konan, Japan

[73] Assignee: Diesel Kiki Co., Ltd., Tokyo, Japan

[21] Appl. No.: 432,576

[22] Filed: Oct. 4, 1982

[30] Foreign Application Priority Data

Oct. 9, 1981 [JP] Japan ..... 56-161200

[51] Int. Cl.[3] ..... F04B 49/08

[52] U.S. Cl. ..... 417/274; 92/60.5

[58] Field of Search ..... 417/274–277, 417/562; 92/60.5; 123/48 A, 48 AA, 48 D, 78 A, 78 AA, 78 D, 500, 501, 502, 503

[56] References Cited

U.S. PATENT DOCUMENTS 1,415,025 5/1922 Folsom ..... 123/78 AA
2,984,408 5/1961 Nicholas ..... 417/562
3,998,570 12/1976 Jacobs ..... 417/274

FOREIGN PATENT DOCUMENTS 872630 2/1953 Fed. Rep. of Germany ..... 92/60.5

*Primary Examiner*—Edward K. Look
*Attorney, Agent, or Firm*—David G. Alexander

[57] ABSTRACT

A simple capacity modulation device for a compressor is disclosed which includes a modulating member slidably disposed in a cylindrical enclosure associated with a compression chamber. Pressure from a low pressure chamber or a high pressure chamber is piloted to one end of the modulating member while pressure in the compression chamber is applied to the other end. The modulating member moves to and remains in a position for increasing or decreasing the top volume of the compression chamber in response to a pressure differential acting thereon.

4 Claims, 3 Drawing Figures

CAPACITY MODULATION DEVICE FOR COMPRESSOR

BACKGROUND OF THE INVENTION

The present invention generally relates to compressors for compressing refrigerant or like fluid therein and, more particularly, to a device for modulating the capacity of a compressor.

Various types of capacity modulation devices have heretofore been proposed for compressors, such as one which forces an intake valve to open for venting a cylinder bore and one which bypasses compressed fluid from a compression chamber back to the suction side. However, all these conventional types of capacity modulation devices cannot avoid intricacy of construction due to the provision of an unloading valve, a capacity regulating valve or like valving arrangement.

Another type of compressor capacity modulation device is known which is specifically directed to preventing the evaporator of an automotive air conditioning system from frosting up, as disclosed in U.S. Pat. No. 3,998,570. The device includes a second or modulating piston in addition to a usual double acting piston adapted to compress fluid in a compression chamber. A bellows is extendible within a space between the modulating piston and double acting piston to automatically modulate the displacement of the compressor. This type of device, however, suffers from various problems such as limited responsiveness and limited durability of the bellows.

SUMMARY OF THE INVENTION

In a compressor having a double acting piston slidably received in a cylindrical bore formed in a cylinder block, and a cylinder head mounted on an end of the cylinder block with a valve plate held therebetween, the piston defining a variable volume compression chamber in cooperation with the cylinder block and valve plate for compressing fluid therein, the cylinder head defining a low pressure chamber for temporary storage of fluid to be sucked into the compression chamber and a high pressure chamber for temporary storage of fluid discharged from the compression chamber, a capacity modulation device embodying the present invention includes an enclosure associated with the compression chamber and a modulating member received in the enclosure to be movable in response to a pressure differential acting thereon. The modulating member defines a first chamber and a second chamber at opposite sides thereof. The first chamber is communicated to the compression chamber. Back pressure restriction means restricts back pressures acting on the modulating member so that the effective pressure receiving area of the modulating member becomes smaller at one end than at the other end. The second chamber in the enclosure is selectively communicated to the high pressure chamber and low pressure chamber by communication control means. With this arrangement, the modulating member remains in a position to increase the top volume of the compression chamber when the second chamber is communicated to the low pressure chamber by the communication control means and in a position to decrease the top volume when the second chamber is communicated to the high pressure chamber.

In accordance with the present invention, a simple capacity modulation device for a compressor includes a modulating member slidably disposed in a cylindrical enclosure associated with a compression chamber. Pressure from a low pressure chamber or a high pressure chamber of the compressor is piloted to one end of the modulating member while pressure in the compression chamber is applied to the other end. The modulating member moves to and remains in a position for increasing or decreasing the top volume of the compression chamber in response to a pressure differential acting thereon.

It is an object of the present invention to provide a capacity modulation device for a compressor which is simple and small in construction and incostly.

It is another object of the present invention to provide a generally improved capacity modulation device for a compressor.

Other objects, together with the foregoing, are attained in the embodiments described in the following description and illustrated in the accompanying drawing.

DESCRIPTION OF THE PREFERRED EMBODIMENTS

While the capacity modulation device for a compressor of the present invention is susceptible of numerous physical embodiments, depending upon the environment and requirements of use, substantial numbers of the herein shown and described embodiments have been made, tested and used, and all have performed in an eminently satisfactory manner.

Figure 1:
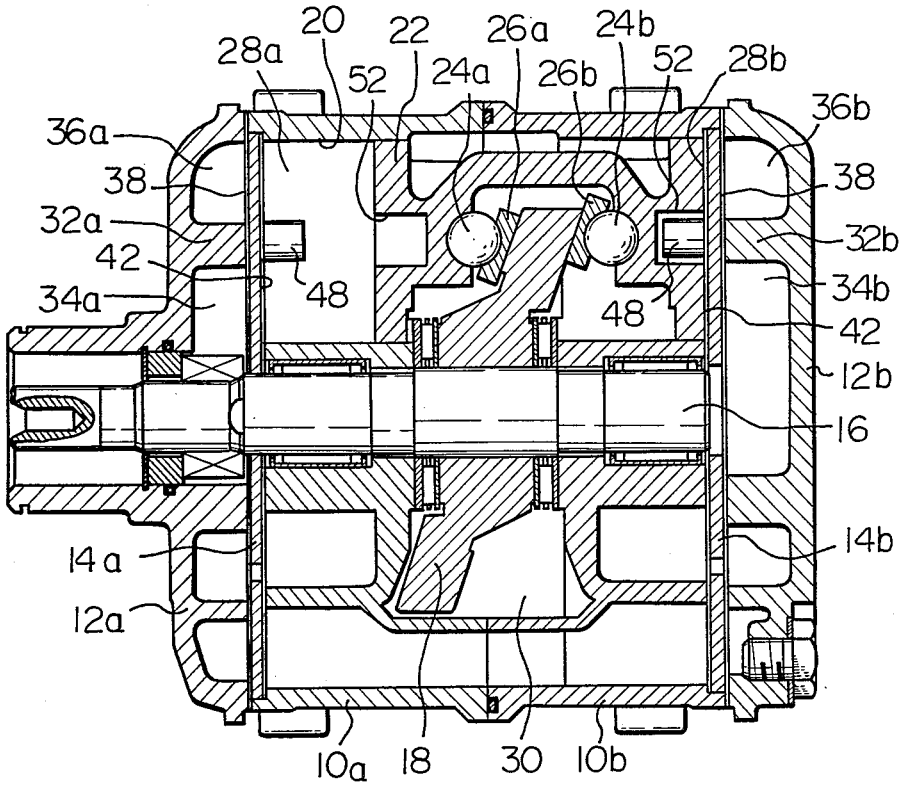
FIG. 1 is a section of a swashplate compressor in which a capacity modulation device embodying the present invention is installed.

Referring to FIG. 1 of the drawing, a swashplate compressor is shown in which a capacity modulation device embodying the present invention is arranged. The compressor includes a cylinder block made up of a pair of cylinder block parts 10*a* and 10*b* which are connected together in a predetermined relative position. Cylinder heads 12*a* and 12*b* are rigidly mounted on axially opposite ends of the cylinder block 10 with valve plates 14*a* and 14*b* firmly retained therebetween, respectively. A drive shaft 16 extends into the cylinder block 10 along the center axis of the latter and is driven from an engine. A swashplate 18 is mounted on the drive shaft 16 while being inclined relative to the drive shaft 16. The drive shaft 16 with the swashplate 18 is journalled to the cylinder block 10.

The cylinder block 10 is formed with at least one (usually three) cylindrical bore 20 in parallel with the drive shaft 16. A double acting piston 22 is slidably supported within each of the cylinder bores 20. The piston 22 engages axially opposite faces of the swashplate through spherical bearings 24*a* and 24*b* and thrust bearing shoes 26*a* and 26*b*, respectively. A compression chamber 28*a* is defined by the cylinder block 10, valve plate 14*a* and one axial end of the piston 22 and, likewise, a compression chamber 28*b* is defined by the cylinder block 10, valve plate 14*b* and the other axial end of the piston 22. The reference numeral 30 designates a crank case formed in the cylinder block 10 and in which the swashplate 18 is positioned. When the drive shaft 16 is driven to rotate the inclined swashplate 18, the piston 22 is caused into reciprocation within the cylinder bore 20 to vary the volumes of the opposite compression chambers 28*a* and 28*b*.

The cylinder heads 12*a* and 12*b* are formed with annular partition walls 32*a* and 32*b*, respectively. The partition wall 32*a* divides the interior of the cylinder head 12*a* into a low pressure chamber 34*a* and a high pressure chamber 36*a*. Likewise, the partition wall 32*b* divides the interior of the cylinder head 12*b* into a low pressure chamber 34*b* and a high pressure chamber 36*b*. Gaskets 38 are rigidly held between the valve plates 14 and their associated cylinder heads 12 so as to provide fluid tight sealing between the low pressure chambers 34 and adjacent high pressure chambers 36. Each low pressure chamber 34 is communicated with the adjacent compression chamber 28 through an inlet port 40 (see FIG. 2) which is formed through the corresponding valve plate 14 and closed by an intake valve 42. The low pressure chamber 34 serves as a temporary storage for fluid which is to be sucked into the compression chamber 28. Each high pressure chamber 36 is communicated with the compression chamber 28 through an outlet port 44 formed through the valve plate 14 and closed by a delivery valve 46 (see FIG. 2). The high pressure chamber 36 functions to temporarily store fluid discharged from the compression chamber 11. As the piston 22 reciprocates within the bore 20 driven by the swashplate 18, the volume of each compression chamber 28 is varied so that the valves 42 and 46 are opened and closed alternately to compress fluid admitted in the compression chamber.

Figure 2:
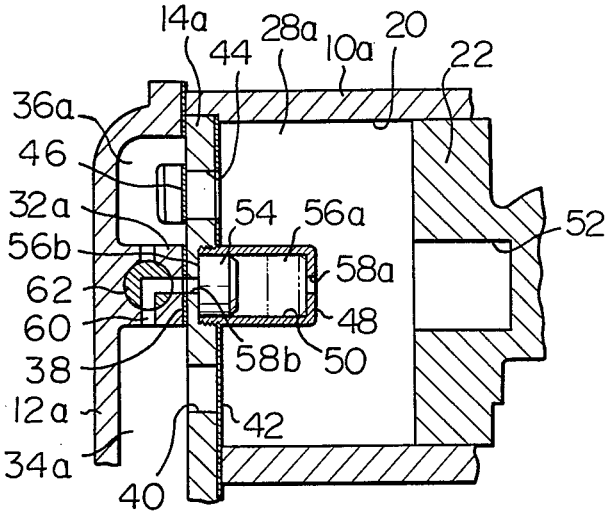
FIG. 2 is an enlarged fragmentary section of the compressor shown in FIG. 1 and indicating the capacity modulation device in detail.

Referring to FIG. 2, the capacity modulation device includes a generally cylindrical casing 48 rigidly mounted on that face of the valve plate 14*a* which defines the compression chamber 28*a*. The casing 48 is also visible in the general construction shown in FIG. 1 and defines a cylindrical bore 50 thereinside. The piston 22 is formed with a recess 52 which is shaped and dimensioned to accommodate the casing 48. A circular modulating member 54 is slidably received in the bore 50 of the casing 48, dividing the bore 50 into chambers 56*a* and 56*b*. Back pressure restriction openings 58*a* and 58*b* are formed at axially opposite ends of the bore 50 with which the modulating member 54 is engagable as will be described, so that the effective area of one end of the modulating member 54 for receiving a back pressure can be made smaller than that of the other end. The chamber 56*a* in the casing 48 is communicated to the compression chamber 28*a* by the opening 58*a*. The other chamber 56*b* is communicated with a generally T-shaped pilot passageway 60 by the opening 58*b*.

The pilot passageway 60 is formed through the valve plate 14*a*, gasket 38 and cylinder head 12*a* and branched into communication with the low pressure chamber 34*a* and high pressure chamber 36*a*. A solenoid operated three-way rotary valve 62 is disposed in the pilot passageway 60 in the cylinder head 12*a* to be movable such that the pilot passageway 60 communicates the chamber 56*b* selectively to the low pressure chamber 34*a* and high pressure chamber 36*a*. In detail, when the rotary valve 62 is positioned to provide communication between the pilot passageway 60 and the low pressure chamber 34*a* as indicated in FIG. 2, the chamber 56*b* is communicated to the low pressure chamber 34*a* to receive low pressure fluid therefrom. When rotated 90° from the position shown in FIG. 2, the rotary valve 62 communicates the pilot passageway 60 to the high pressure chamber 36*a* so that compressed fluid is admitted in the chamber 56*b*.

In operation, the chamber 56*a* in the casing 48 is constantly communicated with the compression chamber 28*a*. While the directional control valve 62 is controlled to communicate the pilot passageway 60 to the low pressure chamber 34*a*, the other chamber 56*b* is communicated to the low pressure chamber 34*a* via the pilot passageway 60. Under this condition, as the double acting piston 22 moves for a compression stroke toward the valve plate 24*a*, the pressure inside the chamber 56*a* becomes higher than the pressure in the chamber 56*b* thereby urging the modulating member 54 into abutment against the left end of the bore 50. This makes the effective back pressure receiving area of the member 54 smaller at the left end than at the right end, due to the calibrated back pressure restriction opening 58*b*. During the subsequent intake stroke, the modulating member 54 remains in contact with the left end of the bore 50 despite that the pressure inside the compression chamber 28*a* becomes lower than the pressure in the low pressure chamber 34*a*, because the actual pressure acting on the member 54 is larger at the right end than at the left end. Thus, the modulating chamber 46*a* becomes filled with compressed fluid during a final portion of the compression stroke, but releases the trapped fluid back into the compression chamber 28*a* upon the subsequent intake stroke. This reduces the amount of a fresh supply of fluid into the compression chamber 28*a* by the proportion of the compressed fluid returned to the compression chamber 28*a*, thereby lowering the volumetric efficiency and, accordingly, the capacity of the compressor.

When the directional control valve 62 is rotated 90° to communicate the pilot passageway 60 to the high pressure chamber 36*a*, the high pressure in the chamber 36*a* is steered to the chamber 56*b* in the casing 48. Then, due to the pressure differential on opposite sides of the modulating member 54, the modulating member 54 is shifted to the right into abutment against the right end of the bore 50. This time, the back pressure restriction opening 58*a* reduces the effective back pressure receiving area on the right end of the modulating member 54. During a compression stroke, despite that the pressure in the compression chamber 28*a* rises beyond the pressure in the high pressure chamber 36*a*, the modulating member 54 is kept in contact with the right end of the bore 50 as indicated by the phantom line in FIG. 2, because the actual pressure acting on the modulating member 54 is higher at the left end than at the right end. In this situation, the compressor is operated with the minimum top volume as during normal operations; the volumetric efficiency is improved to regain the non-modulated capacity.

As described above, it is the pressure differential between the compression chamber 28*a* and the low pressure chamber 34*a* or the high pressure chamber 36*a* that retains the modulating member 54 in either one of the two positions. Stated another way, the back pressures acting on the member 54 follow any variation in the pressure in the compression chamber 28*a* which results from a change in compressor operation speed. It will thus be seen that the modulating member 54 can be appropriately pressed against either end of the bore 50.

Figure 3:
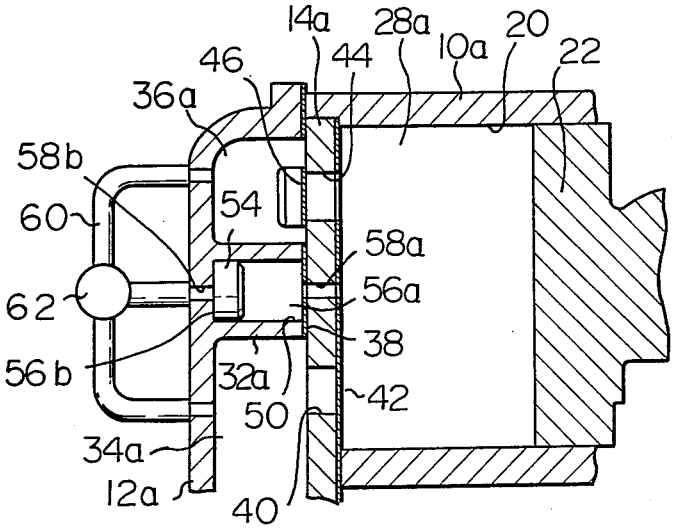
FIG. 3 is a view corresponding to FIG. 2 but showing another embodiment of the present invention.

Referring to FIG. 3, another embodiment of the present invention is shown which is essentially similar to the first embodiment but different chiefly in the location of the bore 50 in the compressor. As shown, the wall 32*a* of the cylinder head 12*a* is shaped to define the bore 50 thereinside. The back pressure restriction opening 58*a* is formed by a through passageway in the intake valve 42, valve plate 14*a* and gasket 38. The other back pressure restriction opening is formed through the cylinder head 12*a*. It will be understood that such a location of the bore 50 eliminates the need for machining the piston 22 to accommodate the casing 48, while preventing the compressor capacity from being lowered under normal operating conditions.

In summary, it will be seen that the present invention provides a capacity modulation device for a compressor which is simple in construction, small in size and low in cost due to the absence of a valving arrangement or the like heretofore required.

Various modifications will become possible for those skilled in the art after receiving the teachings of the present disclosure without departing from the scope thereof.

What is claimed is:

1. In a compressor having a double acting piston slidably received in a cylindrical bore formed in a cylinder block, and a cylinder head mounted on an end of the cylinder block with a valve plate held therebetween, the piston defining a variable volume compression chamber in cooperation with the cylinder block and valve plate for compressing fluid therein, the cylinder head defining a low pressure chamber for temporary storage of the fluid to be sucked into the compresson chamber and a high pressure chamber for temporary storage of the fluid discharged from the compression chamber, a capacity modulation device comprising:

an enclosure;

a modulating member received in said enclosure to be movable in response to a pressure differential acting thereon, said modulating member defining a first chamber and a second chamber at opposite sides thereof, said first chamber being communicated to the compression chamber;

back pressure restriction means for restricting back pressures acting on the modulating member so that the effective pressure receiving area of the modulating member becomes smaller at one end than at the other end; and communication control means for communicating said second chamber in the enclosure selectively to the high pressure chamber and the low pressure chamber;

whereby the modulating member remains in a position to increase the top volume of the compression chamber when the second chamber is communicated to the low pressure chamber by the communication control means and in a position to decrease the top volume when the second chamber is communicated to the high pressure chamber;

the back pressure restriction means comprising openings formed through opposite ends of the enclosure, the first chamber being communicated to the compression chamber through one of said openings and the second chamber being communicated selectively to the low pressure chamber and high pressure chamber through the other opening and communication control means, respectively.

2. A capacity modulation device as claimed in claim 1, in which the enclosure is defined by a cylindrical casing mounted on one face of the valve plate which defines the compression chamber in conjunction with the piston and cylinder block, the piston being formed with a recess for accommodating the casing as the piston strokes toward the valve plate.

3. A capacity modulation device as claimed in claim 1, in which the enclosure is defined within the cylinder head.

4. A capacity modulation device as claimed in claim 1, in which the communication control means comprises a pilot passageway extending from the second chamber in the enclosure and branching into the low pressure chamber and high pressure chamber in the cylinder head, and a direction control member disposed in a branching point of the pilot passageway.

* * * * *